US012716587B2

(12) United States Patent
Chiranthan et al.

(10) Patent No.: US 12,716,587 B2
(45) Date of Patent: Aug. 25, 2026

(54) LINER ASSEMBLY FOR A COMBUSTOR

(71) Applicant: General Electric Company, Evendale, OH (US)

(72) Inventors: Ranganatha Narasimha Chiranthan, Bengaluru (IN); Hiranya Nath, Bengaluru (IN); Girish Kamath Cannanore, Bengaluru (IN); Ravindra Shankar Ganiger, Bengaluru (IN); Pradeep Naik, Bengaluru (IN); Saket Singh, Bengaluru (IN); Deepti Bhandari, Bengaluru (IN); Vijayaraj Sukumar, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 19/052,767

(22) Filed: Feb. 13, 2025

(65) Prior Publication Data

US 2025/0180207 A1 Jun. 5, 2025

Related U.S. Application Data

(62) Division of application No. 17/811,771, filed on Jul. 11, 2022, now Pat. No. 12,234,987.

(30) Foreign Application Priority Data

Mar. 31, 2022 (IN) ..... 202211019363

(51) Int. Cl.
*F23R 3/00* (2006.01)
*F23R 3/60* (2006.01)

(52) U.S. Cl.
CPC ..... *F23R 3/002* (2013.01); *F23R 3/60* (2013.01); *F23R 2900/00014* (2013.01); *F23R 2900/00017* (2013.01); *F23R 2900/03043* (2013.01)

(58) Field of Classification Search
CPC .. F23R 3/002; F23R 3/60; F23R 2900/00014; F23R 2900/00017; F23R 2900/03043
See application file for complete search history.

(56) References Cited

U.S. PATENT DOCUMENTS 2,795,108 A 6/1957 Saldin
4,259,842 A * 4/1981 Koshoffer ..... F23R 3/08 60/757

(Continued)

FOREIGN PATENT DOCUMENTS

CN 109477637 A 3/2019
EP 3453968 B1 10/2021

OTHER PUBLICATIONS

Final Report on Incident to M/S/ Indigo Airlines Airbus A320 Aircraft VT-ITF AT Mumbai on Jan. 21, 2017, Jan. 3, 2019, 39 pages. [Cited in Parent].

*Primary Examiner* — Devon C Kramer
*Assistant Examiner* — Henry Ng
(74) *Attorney, Agent, or Firm* — Venable LLP; Michele V. Frank

(57) ABSTRACT

A liner assembly for a combustor. The liner assembly includes a liner defining a combustion chamber of the combustor. The liner includes a looped section at a forward end of the liner. The looped section includes one or more bends such that the looped section forms a compliant joint and vibrations are dampened through the liner downstream of the looped section.

20 Claims, 6 Drawing Sheets

(56) References Cited

U.S. PATENT DOCUMENTS

| | | | | |
|---|---|---|---|---|
| 4,567,730 | A * | 2/1986 | Scott | F23R 3/002 60/753 |
| 4,622,821 | A | 11/1986 | Madden | |
| 4,655,044 | A * | 4/1987 | Dierberger | F23R 3/002 60/753 |
| 4,848,089 | A | 7/1989 | Cramer | |
| 6,266,961 | B1 * | 7/2001 | Howell | F23R 3/002 60/752 |
| 6,351,947 | B1 | 3/2002 | Keller et al. | |
| 6,655,147 | B2 * | 12/2003 | Farmer | F23R 3/50 60/754 |
| 6,725,667 | B2 | 4/2004 | Farmer et al. | |
| 6,976,363 | B2 | 12/2005 | McMasters et al. | |
| 7,849,696 | B2 | 12/2010 | De Sousa et al. | |
| 10,612,780 | B2 | 4/2020 | Mulcaire | |
| 10,808,930 | B2 | 10/2020 | Schlichting | |
| 11,098,653 | B2 | 8/2021 | Moura et al. | |
| 11,402,097 | B2 | 8/2022 | Stieg et al. | |
| 2005/0097890 | A1 | 5/2005 | Ikeda et al. | |
| 2010/0071376 | A1 * | 3/2010 | Wiebe | F23R 3/34 60/740 |
| 2013/0042627 | A1 | 2/2013 | Gerendas et al. | |
| 2016/0076772 | A1 | 3/2016 | Metternich et al. | |
| 2017/0059167 | A1 | 3/2017 | Bloom et al. | |
| 2018/0187889 | A1 | 7/2018 | Mulcaire | |
| 2018/0274780 | A1 | 9/2018 | Kim et al. | |
| 2018/0335211 | A1 * | 11/2018 | Quach | F23R 3/002 |
| 2019/0017441 | A1 | 1/2019 | Venkatesan et al. | |
| 2020/0088410 | A1 * | 3/2020 | Dillard | F23R 3/007 |
| 2020/0116360 | A1 | 4/2020 | White et al. | |
| 2020/0124281 | A1 * | 4/2020 | Dillard | F23R 3/50 |
| 2021/0003284 | A1 * | 1/2021 | Fong | F01D 9/023 |
| 2021/0055000 | A1 * | 2/2021 | Ichihashi | F01D 25/12 |
| 2021/0063016 | A1 | 3/2021 | Stieg et al. | |
| 2021/0278082 | A1 | 9/2021 | Vallejo Ruiz et al. | |
| 2021/0341150 | A1 | 11/2021 | Matsuyama et al. | |
| 2024/0027066 | A1 * | 1/2024 | Nath | F23R 3/50 |

* cited by examiner

LINER ASSEMBLY FOR A COMBUSTOR

CROSS REFERENCE TO RELATED APPLICATIONS

This application is a divisional of U.S. patent application Ser. No. 17/811,771 filed on Jul. 11, 2022, which claims the benefit of Indian patent application Ser. No. 20/2211019363, filed on Mar. 31, 2022, the contents of both of which are hereby incorporated by reference in their entireties.

TECHNICAL FIELD

The present disclosure relates to a liner assembly for a combustor.

BACKGROUND

A gas turbine engine may include a combustion section having a combustor that generates combustion gases discharged into a turbine section of the gas turbine engine. The combustion section may include a liner assembly. The liner assembly may include a support shell and a heat shield coupled to a hot side of the support shell. The liner assembly may be coupled to a cowl and an annular dome assembly of the combustion section to define portions of the combustor.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
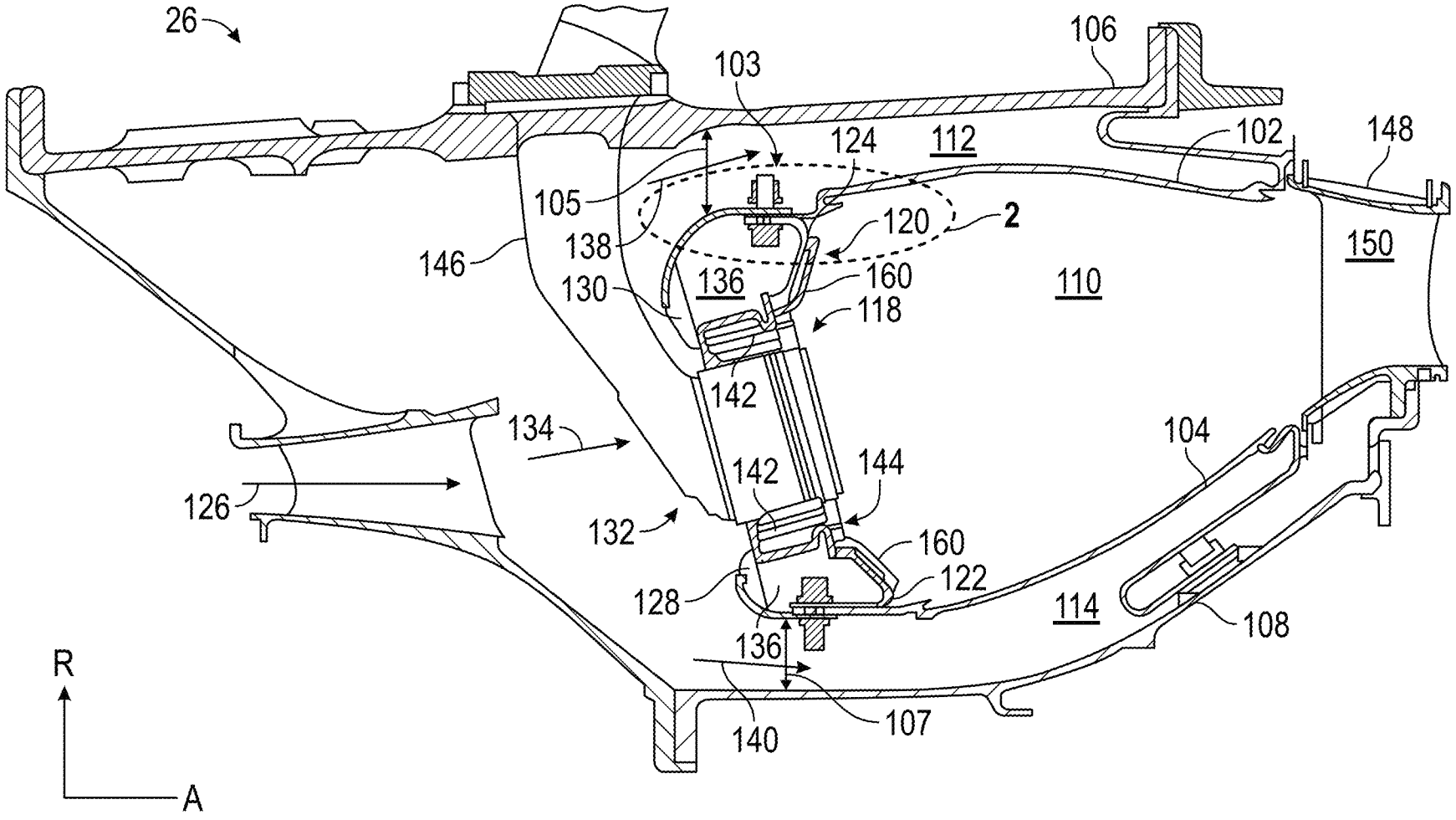
FIG. 1 is a schematic partial cross-sectional view of a portion of an exemplary combustion section having a liner assembly used in a gas turbine engine system, according to an aspect of the present disclosure.

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first," "second," and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached," "connected," and the like, refer to both direct coupling, fixing, attaching, or connecting, as well as indirect coupling, fixing, attaching, or connecting through one or more intermediate components or features, unless otherwise specified herein.

The singular forms "a," "an," and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about," "approximately," "generally," and "substantially" is not to be limited to the precise value specified. In at least some instances, the approximating language may correspond to the precision of an instrument for measuring the value, or the precision of the methods or the machines for constructing the components and/or the systems or manufacturing the components and/or the systems. For example, the approximating language may refer to being within a one, two, four, ten, fifteen, or twenty percent margin in either individual values, range(s) of values and/or endpoints defining range(s) of values.

A cowl and the annular dome assembly of the combustor of the gas turbine engine may be attached, mounted, or otherwise connected to the liner assembly by, for example, one or more bolts. During operation of the gas turbine engine, the liner assembly, and a deflector of the annular dome assembly, experience high thermal gradients due to hot combustion products (e.g., hot combustion gases) in the combustion chamber. In addition to the high thermal gradients, vibrations may propagate from the connection of the cowl, the annular dome assembly, and the liner assembly. The vibrations may propagate through the liner assembly and, in combination with the high thermal gradients, may cause mechanical stress on the liner assembly both at the connection and downstream of the connection. Accordingly, the liner assembly may eventually fail prior to a complete designed lifecycle of the liner assembly. Thus, embodiments of the present disclosure provide for an improved liner assembly for the combustor to improve durability and a lifecycle of the liner assembly compared to liner assemblies without the benefit of the present disclosure.

The liner assembly of the present disclosure may include a looped section at a forward end thereof. The looped section may be bolted or otherwise fastened with the cowl and the dome. The looped section may be shaped to include one or more bends (e.g., U-shaped, Omega-shaped, hairpin bend, etc.) provided in the liner assembly (e.g., in the support shell). The looped section may include a compliant joint, also referred to as a flexure joint or a flexible joint. As used herein, a "compliant joint," a "flexure joint," and/or a "flexible joint" may include a connection that provides multiple degrees of freedom between connected parts of a monolithic structure. For example, the compliant joint provided by the looped section (e.g., via the one or more bends) may help to avoid, to reduce, or to prevent vibrations and/or to avoid, to reduce, or to prevent other mechanical stresses from propagating downstream of the looped section. Thus, the looped section may improve durability of the liner assembly and increase a lifecycle of the liner assembly as compared to liner assemblies without the benefit of the present disclosure.

The looped section may include an air cavity formed therein. The air cavity may receive cooling air from the compressor section of the gas turbine engine. The feed into the air cavity may be metered and downstream holes may be used to direct the cooling air from the air cavity. In this way, the air cavity may act as an acoustic damper to further dampen vibrations and mechanical stress. The looped section, and, therefore, the air cavity, may be shaped to achieve a designed frequency.

The bolts may be inserted through a hole in a radially outer portion of the looped section such that the bolts may be disposed within the air cavity. Submerging the bolts in the air cavity in this way may provide for improved aerodynamic feed into the air cavity. The holes for the bolts may be sealed to prevent or to control air flow using a U-shaped washer or a similar seal. The volume of the air cavity, a length of a neck of the looped section, and an area of an opening of the neck may be sized and/or shaped to tune the looped section to a specific frequency, as desired. The air cavity may include a single annular cavity and/or may include one or more partitions in a radial, an axial, and/or a circumferential direction such that the air cavity is partitioned into separate cavities. The looped section may also include a hairpin bend to direct cooling air towards the dome and to create an additional damping cavity. The looped section may also include one or more acoustic feed holes to further provide for acoustic damping.

The downstream holes may be sized, shaped, and/or angled to direct the cooling air in a desired direction. For example, the air flow from the air cavity may be used to film cool the support shell and/or the heat shield to help further improve durability of the liner assembly. The flow from the air cavity may also be directed to impinge and to provide cooling on the corners of the dome and/or the deflector assembly. For example, a downstream bend in the looped section may include holes to direct the air flow onto bolts of the deflector assembly. The holes can include any size, shape, and/or angle for directing the flow in a desired direction. The air cavity may include metered holes (e.g., discrete holes) and/or a metered annular opening therein to provide a feed of cooling air into the air cavity. The holes may include one row of holes and/or may include multiple rows.

The looped section at the forward end of the liner assembly may control leakage of cooling air and direct the cooling air along a hot side of the liner assembly. The cowl may be shaped such that it couples with the looped section to provide for a compliant joint, as detailed above. The cowl may be extended to provide for cooling holes and to control leakage on the forward end of the liner assembly. The ratio of the air cavity volume to the cowl volume may be between zero percent to fifty percent. The radius and/or the diameter of the cowl may be sized to keep a distance between an outer combustor casing and the cowl the same as in embodiments without the benefit of the present disclosure. The cooling air directed to the bolts of the deflector assembly may be directed in a radial direction. In some embodiments, the cooling air directed to the bolts of the deflector assembly may be directed tangentially with respect to the bolts.

Referring now to the drawings, FIG. 1 is a schematic partial cross-sectional view of a portion of an exemplary combustion section 26 having a deflector assembly 160 used in a gas turbine engine system, as may incorporate various embodiments of the present disclosure. Gas turbine engine systems may include any suitable configuration, such as, but not limited to, turbofan, turboprop, turboshaft, turbojet, or prop-fan configurations for aviation, marine, or power generation purposes. Still further, other suitable configurations may include steam turbine engines or another Brayton cycle machine. Various embodiments of the combustion section 26 may further define a rich burn combustor. Other embodiments may, however, define a lean burn combustor configuration. In the exemplary embodiment, the combustion section 26 includes an annular combustor. One skilled in the art will appreciate that the combustor may be any other combustor, including, but not limited to, a single annular combustor or a double annular combustor, a can-combustor, or a can-annular combustor.

As shown in FIG. 1, the combustion section 26 defines an axial direction A and a radial direction R that is normal to the axial direction A. The combustion section 26 includes an outer liner assembly 102 and an inner liner assembly 104 disposed between an outer combustor casing 106 and an inner combustor casing 108. The outer liner assembly 102 and the inner liner assembly 104 are spaced radially from each other such that a combustion chamber 110 is defined therebetween. The outer liner assembly 102 and the outer combustor casing 106 form an outer passage 112 therebetween, and the inner liner assembly 104 and the inner combustor casing 108 form an inner passage 114 therebetween.

The combustion section 26 may also include a combustor assembly 118 comprising an annular dome assembly 120 mounted upstream of the combustion chamber 110. The combustor assembly 118 is configured to be coupled to the forward ends of the outer liner assembly 102 and the inner liner assembly 104. More particularly, the combustor assembly 118 includes an inner annular dome 122 attached to the forward end of the inner liner assembly 104 and an outer annular dome 124 attached to the forward end of the outer liner assembly 102.

The combustion section 26 may be configured to receive an annular stream of compressor discharge air 126 from a discharge outlet of a high-pressure compressor (not shown) of the gas turbine engine system. To assist in directing the compressed air (e.g., compressor discharge air 126), the annular dome assembly 120 may further comprise an inner cowl 128 and an outer cowl 130 that may be coupled to the upstream ends of the inner liner assembly 104 and the outer liner assembly 102, respectively. In this regard, an annular opening 132 formed between the inner cowl 128 and the outer cowl 130 enables compressed fluid to enter combustion section 26 through a diffuse opening in a direction generally indicated by flow direction 134. The compressed air may enter into a cavity 136 defined at least in part by the annular dome assembly 120. In various embodiments, the cavity 136 is more specifically defined between the inner annular dome 122 and the outer annular dome 124, and the inner cowl 128 and the outer cowl 130. As will be discussed in more detail below, a portion of the compressed air in the cavity 136 may be used for combustion, while another portion may be used for cooling the combustion section 26.

In addition to directing air into the cavity 136 and the combustion chamber 110, the inner cowl 128 and the outer cowl 130 may direct a portion of the compressed air around the outside of the combustion chamber 110 to facilitate cooling the outer liner assembly 102 and the inner liner assembly 104. For example, as shown in FIG. 1, a portion of the compressor discharge air 126 may flow around the combustion chamber 110, as indicated by an outer passage flow direction 138 and an inner passage flow direction 140, to provide cooling air to the outer passage 112 and the inner passage 114, respectively. A first distance 105 may be defined between the outer cowl 130 and the outer combustor casing 106, and a second distance 107 may be defined between the inner cowl 128 and the inner combustor casing 108. The first distance 105 and the second distance 107 may be sized, as desired, to control an amount of cooling air directed by the outer cowl 130 and the inner cowl 128 around the outside of the combustion chamber 110, respectively.

In certain exemplary embodiments, the inner annular dome 122 may be formed integrally as a single annular component, and, similarly, the outer annular dome 124 may also be formed integrally as a single annular component. In still certain embodiments, the inner annular dome 122 and the outer annular dome 124 may together be formed as a single integral component. In still various embodiments, the annular dome assembly 120, including one or more of the inner annular dome 122, the outer annular dome 124, the outer liner assembly 102, or the inner liner assembly 104, may be formed as a single integral component. In other exemplary embodiments, the inner annular dome 122 and/or the outer annular dome 124 may alternatively be formed by one or more components joined in any suitable manner. For example, with reference to the outer annular dome 124, in certain exemplary embodiments, the outer cowl 130 may be formed separately from the outer annular dome 124 and attached to the forward end of the outer annular dome 124 using, e.g., a welding process, a mechanical fastener, a bonding process or adhesive, or a composite layup process. Additionally, or alternatively, the inner annular dome 122 may have a similar configuration.

The combustor assembly 118 further includes a plurality of mixer assemblies 142 spaced along a circumferential direction between the outer annular dome 124 and the inner annular dome 122. In this regard, the annular dome assembly 120 defines an opening in which a swirler, a cyclone, or a mixer assembly 142 is mounted, attached, or otherwise integrated for introducing the air/fuel mixture into the combustion chamber 110. Notably, compressed air (e.g., compressor discharge air 126) may be directed into or through one or more of the mixer assemblies 142 to support combustion in the upstream end of the combustion chamber 110.

A liquid fuel and/or a gaseous fuel is transported to the combustion section 26 by a fuel distribution system (not shown), where it is introduced at the front end of a burner in a highly atomized spray from a fuel nozzle. In an exemplary embodiment, each mixer assembly 142 may define an opening for receiving a fuel injector 146 (details are omitted for clarity). The fuel injector 146 may inject fuel in a generally axial direction A, as well as in a generally radial direction R, where the fuel may be swirled with the incoming compressed air. Thus, each mixer assembly 142 receives compressed air from the annular opening 132 and fuel from a corresponding fuel injector 146. Fuel and pressurized air are swirled and mixed together by the mixer assemblies 142, and the resulting fuel/air mixture is discharged into combustion chamber 110 for combustion thereof.

The combustion section 26 may further comprise an ignition assembly (e.g., one or more igniters extending through the outer liner assembly 102) suitable for igniting the fuel-air mixture. Details of the fuel injectors and the ignition assembly are omitted in FIG. 1 for clarity. Upon ignition, the resulting hot combustion gases may flow in a generally axial direction through the combustion chamber 110 into and through the turbine section of the engine where a portion of thermal and/or kinetic energy from the hot combustion gases is extracted via sequential stages of turbine stator vanes and turbine rotor blades. More specifically, the hot combustion gases may flow into an annular, first stage turbine nozzle 148. As is generally understood, the first stage turbine nozzle 148 may be defined by an annular flow channel that includes a plurality of radially extending, circularly spaced nozzle vanes 150 that turn the gases so that they flow angularly and impinge upon the first stage turbine blades of a high-pressure turbine of the gas turbine engine system.

Referring still to FIG. 1, the plurality of mixer assemblies 142 are placed circumferentially within the annular dome assembly 120. Fuel injectors 146 are disposed in each mixer assembly 142 to provide fuel and to support the combustion process. Each dome has a heat shield, for example, a deflector assembly 160 that thermally insulates the annular dome assembly 120 from the extremely high temperatures generated in the combustion chamber 110 during engine operation (e.g., from the hot combustion gases). The inner annular dome 122, the outer annular dome 124, and the deflector assembly 160 may define a plurality of openings 144 for receiving the mixer assemblies 142. As shown, the plurality of openings 144 are, in one embodiment, circular. In other embodiments, the openings 144 are ovular, elliptical, polygonal, oblong, or other non-circular cross sections. The deflector assembly 160 is mounted on a combustion chamber side (e.g., a downstream side) of the annular dome assembly 120. The deflector assembly 160 may include a plurality of panels, as detailed further below.

Compressed air (e.g., compressor discharge air 126) flows into the annular opening 132 where a portion of the compressor discharge air 126 will be used to mix with fuel for combustion and another portion will be used for cooling the deflector assembly 160. Compressed air may flow around the fuel injector 146 and through the mixing vanes around the circumference of the mixer assemblies 142, where compressed air is mixed with fuel and directed into the combustion chamber 110. Another portion of the air enters into the cavity 136 defined by the annular dome assembly 120, the inner cowl 128, and the outer cowl 130. The compressed air in the cavity 136 is used, at least in part, to cool the annular dome assembly 120 and the deflector assembly 160, as detailed further below.

Figure 2:
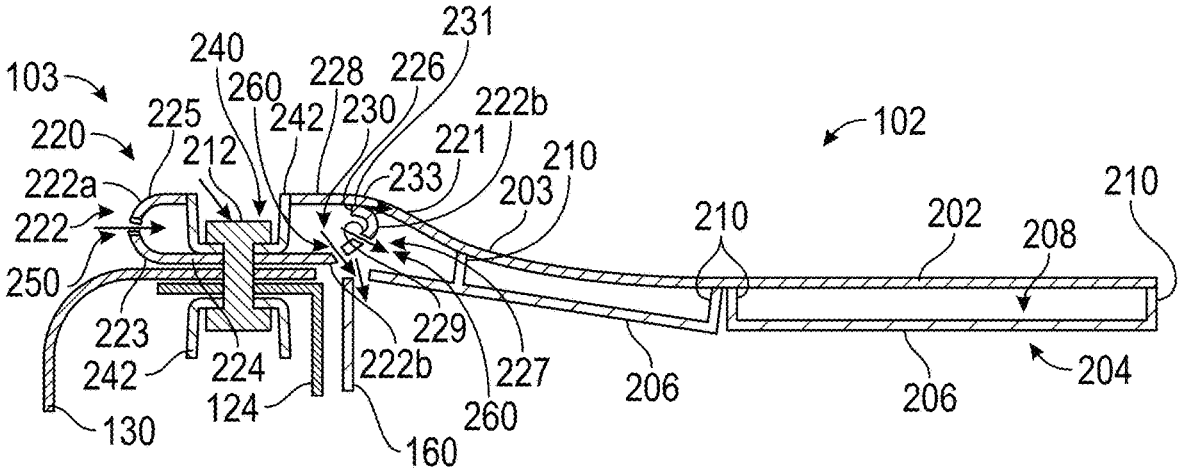
FIG. 2 is a schematic partial cross-sectional view of a forward end of the liner assembly, taken at detail 2 in FIG. 1, according to an aspect of the present disclosure.

FIG. 2 is a schematic partial cross-sectional view of a forward end 103, or an upstream end, of the outer liner assembly 102, taken at detail 2 in FIG. 1. While the exemplary embodiments detailed herein refer to the outer liner assembly 102, embodiments of the present disclosure are also applicable to the inner liner assembly 104. As shown in FIG. 2, the outer liner assembly 102 may include a support shell, also referred to as a liner 202, and a heat shield 204. In the exemplary embodiments, the liner 202 may be generally cylindrical, but may take any known shape of a liner for a combustor. The heat shield 204 may include one or more tiles or panels 206 arranged on and coupled to a hot side of the liner 202. That is, the panels 206 of the heat shield 204 may be coupled on a side of the liner 202 exposed to the combustion chamber 110 (FIG. 1). Two panels 206 of the heat shield 204 are depicted in FIG. 2 but the heat shield 204 may include any number of panels 206, as desired. The liner 202 may be non-ceramic. In some examples, the liner 202 may be a metal liner. The panels 206 of the heat shield 204 may be ceramic. In some examples, the panels 206 may be ceramic matrix composites (CMC). Thus, the heat shield 204 may provide a shield for the liner 202, enhancing the life of the liner 202.

The outer liner assembly 102 may include a one or more fastening mechanisms (not shown) for attaching and connecting the liner 202 and the panels 206 of the heat shield 204. That is, each of the panels 206 is coupled by the one or more fastening mechanisms to the liner 202. The fastening mechanisms may include any type of known fastening mechanism such as, for example, bolts, screws, nuts, rivets, brazing, welding, or the like. A gap or a space 208 may be located between a radially outer surface of each of the panels 206 and a radially inner surface of the liner 202. The space 208 may be formed due to the fastening mechanisms. Each of the panels 206 may include one or more panel walls 210 extending from a radially outer surface of each of the panels 206. When the panels 206 of the heat shield 204 are attached, connected, or otherwise mounted to the liner 202, the panel walls 210 may extend to, and contact, the radially inner surface of the liner 202. The liner 202 and the heat shield 204 may each include one or more cooling holes respectively therethrough for providing cooling air to portions of the combustion chamber 110 (FIG. 1), as detailed further below.

The outer annular dome 124 and the outer cowl 130 may be attached or otherwise mounted to the outer liner assembly 102 at the forward end 103 or the upstream end of the outer liner assembly 102. For example, the outer annular dome 124 and the outer cowl 130 may be attached to the forward end 103 of the liner 202 of the outer liner assembly 102. One or more fastening mechanisms 212 may fasten the outer annular dome 124 and the outer cowl 130 to the forward end 103 of the liner 202. In some instances, the liner 202 may be exposed to high mechanical and thermal stresses around an area of the fastening mechanisms 212 (e.g., at the forward end 103 of the liner 202) in outer liner assemblies without the benefit of the present disclosure. Thus, the present disclosure provides for a liner 202 having a looped section at the forward end 103 of the liner 202, as detailed further below.

In FIG. 2, the liner 202 may include a looped section 220 that defines the forward end 103 of the liner 202. The looped section 220 may include one or more bends 222 in the liner 202 to form the looped section 220. For example, the liner 202 may include a unitary length of liner 202 bent at a first bend 222*a* to form an elongated U-shape or an elongated C-shape defining the looped section 220. In this way, the first bend 222*a* may form a smoothly curved, arcuate configuration. The first bend 222*a* may include a first diameter. The size (e.g., the first diameter) and/or the shape of the first bend 222*a* may include any size and/or shape, as desired, for forming the looped section 220 at the forward end 103 of the liner 202. The first bend 222*a* may include a first portion 223 and a second portion 225. The first bend 222*a* may be oriented such that the first portion 223 is a radially inner portion and the second portion 225 is a radially outer portion.

The looped section 220 may include a free wall 224, e.g., a wall with a free end 226, and a connecting wall 228. The free wall 224 may extend from the first portion 223 of the first bend 222*a* and the connecting wall 228 may extend from the second portion 225 of the first bend 222*a*. For example, the free wall 224 and the connecting wall 228 may each merge into the first bend 222*a* at the first portion 223 and the second portion 225, respectively. In this way, the connecting wall 228 may be spaced radially from the free wall 224 and a cavity 230 may be defined between the connecting wall 228 and the free wall 224. The cavity 230 may include a height or a diameter defined between the free wall 224 and the connecting wall 228. The cavity 230 may also include a volume. Thus, the connecting wall 228 may define a radially outer portion of the looped section 220 and the free wall 224 may define a radially inner portion of the looped section 220. The free wall 224 and the connecting wall 228 may preferably be generally rectilinear, but are not limited to such a straight-line configuration. The looped section 220 may be partitioned (e.g., by one or more walls) axially, radially, and/or circumferentially such that the looped section 220 may include one or more partitions.

An axial length of the free wall 224 may include a length such that the free wall 224 extends from the first bend 222*a* to adjacent a distal end of the outer cowl 130. The free wall 224 may include an axial length that extends beyond (e.g., axially distal) the distal end of the outer cowl 130 and/or an axial length that extends axially proximal the distal end of the outer cowl 130. The connecting wall 228 may include a length that extends from the first bend 222*a* to a proximal end of an axially extending portion 203 of the liner 202. The axial length of the free wall 224 and the connecting wall 228 may include a length such that the first bend 222*a* is positioned axially adjacent to a bent portion of the outer cowl 130 when the outer cowl 130 is mounted to the liner 202.

The connecting wall 228 may be connected to the axially angled portion 203 of the liner 202. In this way, the looped section 220 may form a unitary structure of the liner 202. In some examples, the looped section 220 may be formed separately from the axially angled portion 203 of the liner 202 and may be connected to or attached to the axially angled portion 203 by brazing, welding, or the like. A connecting bend 221 may be formed between the connecting wall 228 and the axially angled portion 203 of the liner 202. The connecting bend 221 may direct the shape of the liner 202 from the axially angled portion 203 to the connecting wall 228 such that the connecting wall 228 extends substantially axially (e.g., rectilinear). The connecting bend 221 may include any size and/or shape, as desired, for forming a smooth transition between the axially angled portion 203 and the connecting wall 228.

The free wall 224 includes one or more second bends 222*b*. The one or more second bends 222*b* may be located at an axially distal end of the free wall 224. In FIG. 2, the one or more second bends 222*b* include two second bends 222*b* such that the axially distal end of the free wall 224 defines a distal bent portion 227. The distal bent portion 227 includes a first angled portion 229 and a second angled portion 231. The first angled portion 229 may extend from the substantially rectilinear portion of the free wall 224 at an axial angle greater than zero. The second angled portion 231 may extend from the first angled portion 229 at an axial angle greater than zero. In this way, the free end 226 of the free wall 224 may be positioned radially outer from the substantially rectilinear portion of the free wall 224. In FIG. 2, the free end 226 may be positioned adjacent a radially inner surface of the connecting wall 228 such that a gap 233 is formed between the free end 226 and the radially inner surface of the connecting wall 228. The gap 233 may include any size, as desired, for controlling an amount of cooling air that may be directed through the gap 233, as detailed further below.

The looped section 220 may include one or more fastener holes 240 extending therethrough to receive the one or more fastening mechanisms 212. In this way, the outer annular dome 124 and the outer cowl 130 may be fastened to the outer liner assembly 102 at the looped section 220. One such fastener hole 240 is shown in FIG. 2. The fastener hole 240 may include a first fastener hole extending through the connecting wall 228 and a second fastener hole extending through the free wall 224. The one or more fastening mechanisms 212 may be inserted through the first fastener hole, into the cavity 230, and through the second fastener hole. The one or more fastening mechanisms 212 may be inserted through respective fastener holes of the outer annular dome 124 and the outer cowl 130 to fasten or otherwise to secure the outer annular dome 124 and the outer cowl 130 to the liner 202 at the looped section 220. In this way, the one or more fastening mechanisms 212 may be situated or otherwise disposed within the cavity 230 when the outer annular dome 124 and the outer cowl 130 are mounted to the liner 202. For example, the looped section 220 may be considered to loop around the one or more fastening mechanisms 212.

One or more seals 242 may seal the fastener holes 240 to prevent and/or to control air flow through the fastener holes 240. For example, the one or more seals 242 may include one or more U-shaped or curved washers (shown in FIG. 2) to seal the fastener holes 240. The one or more seals 242 may include any type of known seal for sealing the fastener holes 240. Two such seals 242 are shown in FIG. 2. For example, a first seal 242 is positioned between the fastening mechanism 212 and the free wall 224 to prevent air leakage through an area around the fastening mechanism 212. A second seal 242 is positioned between the fastening mechanism 212 and the outer cowl 130 to further prevent air leakage through the area around the fastening mechanism 212. In some examples, the one or more seals 242 may include a size and/or a shape substantially similar to a size and/or a shape of the fastener hole 240 (e.g., the fastener hole through the connecting wall 228). In this way, the one or more seals 242 may span a diameter of the fastener hole 240 to seal the fastener hole 240.

When the liner 202 includes the looped section 220 of the present disclosure, the first distance 105 (FIG. 1) may be defined by the connecting wall 228 and the outer combustor casing 106. The looped section 220 may decrease the first distance 105 due to the looped section 220 extending radially outward from the outer cowl 130. Thus, a diameter of the outer cowl 130 may be sized to maintain the size of the first distance 105, accordingly. For example, the first distance 105 may be substantially equal between embodiments without the looped section 220 and in embodiments with the looped section 220. In this way, the first distance 105 may be maintained while the liner 202 includes the benefit of the present disclosure. A diameter of the inner cowl 128 (FIG. 1) may likewise be sized to maintain the second distance 107 (FIG. 1), accordingly.

The looped section 220 may include one or more first cooling holes 250 for providing cooling air into the cavity 230. For example, the one or more first cooling holes 250 may be located on the first bend 222*a*. The one or more first cooling holes 250 may include one or more metering holes such that the cooling air enters the one or more first cooling holes 250 and exits the one or more first cooling holes 250 as a jet (e.g., velocity of the cooling air is increased as the cooling air passes through the one or more first cooling holes 250). The one or more first cooling holes 250 may include a plurality of discrete cooling holes (e.g., multiple separate cooling holes positioned at various circumferential positions on the looped section 220). In some examples, the one or more first cooling holes 250 may include an annular opening that spans around the circumference of the looped section 220. The one or more first cooling holes 250 may include a combination of discrete cooling holes and/or annular openings. The one or more first cooling holes 250 may include any number of cooling holes, as desired. The one or more first cooling holes 250 may include any size and/or shape, and may be positioned at any angle to provide cooling air into the cavity 230.

The looped section 220 may also include one or more second cooling holes 260 for providing the cooling air from the cavity 230 to one or more components of the combustion section 26, as detailed further below. The one or more second cooling holes 260 may be located on the distal bent portion 227 of the free wall 224. For example, the one or more second cooling holes 260 may extend through the free wall 224 downstream of the one or more first cooling holes 250. The one or more second cooling holes 260 may be positioned and angled to provide cooling air from the cavity 230 to the outer annular dome 124, the deflector assembly 160, the heat shield 204, and/or any other component of the combustion section 26 (FIG. 1) adjacent the looped section 220. The one or more second cooling holes 260 may include one or more metering holes such that the cooling air enters the one or more second cooling holes 260 and exits the one or more second cooling holes 260 as a jet (e.g., velocity of the cooling air is increased as the cooling air passes through the one or more second cooling holes 260). The one or more second cooling holes 260 may include a plurality of discrete cooling holes (e.g., multiple separate cooling holes positioned at various circumferential positions on the looped section 220). In some examples, the one or more second cooling holes 260 may include an annular opening that spans around the circumference of the looped section 220. The one or more second cooling holes 260 may include a combination of discrete cooling holes and/or annular openings. The one or more second cooling holes 260 may include any number of cooling holes, as desired. The one or more second cooling holes 260 may include any size and/or shape, and may be positioned at any angle to provide cooling air from the cavity 230 to various components of the combustion section 26.

In operation, discharge air 126 (FIG. 1) may be directed through the one or more first cooling holes 250 (as indicated by the arrow through first cooling holes 250) to provide cooling air into the cavity 230. For example, the discharge air 126 that is directed along the outer passage flow direction 138 (FIG. 2) may enter the cavity 230 through the one or more first cooling holes 250. The discharge air 126 may also be directed into the cavity 230 through the one or more fastener holes 240 (as indicated by the arrow through fastener holes 240), wherein the one or more seals 242 provide control of the flow of the discharge air 126 through the one or more fastener holes 240. In this way, the one or more fastening mechanisms 212 may be cooled. The cooling air in the cavity 230 may then be directed through the one or more second cooling holes 260 (as indicated by the arrows through the second cooling holes 260). The one or more second cooling holes 260 may include cooling holes to direct the cooling air onto a downstream surface (e.g., a hot side) of the deflector assembly 160 to cool the deflector assembly 160. For example, the cooling air may impinge on the deflector assembly 160 at specific locations around the deflector assembly 160 (e.g., at the corners of the panels of the deflector assembly 160) to prevent hot gas ingestion and to cool the deflector assembly 160. The one or more second cooling holes 260 may also include cooling holes to direct the cooling air into the space 208 and may film cool the one or more panels 206 of the heat shield 204.

The cooling air in the cavity 230 may also be directed through the gap 233 into the space 208 (as indicated by the arrow through the gap 233). The cooling air directed through the gap 233 may provide film cooling on the radially inner surface of the liner 202 (e.g., on the axially angled portion 203). The one or more second cooling holes 260 and the gap 233 may be metered to further increase a velocity of the cooling air from an upstream side to a downstream side of the one or more second cooling holes 260 and the gap 233, respectively. The direction and/or the amount of cooling air through the first cooling holes 250, the second cooling holes 260, and/or the gap 233 may be sized, shaped, and angled to direct the cooling air in various directions, as necessary.

Figure 3:
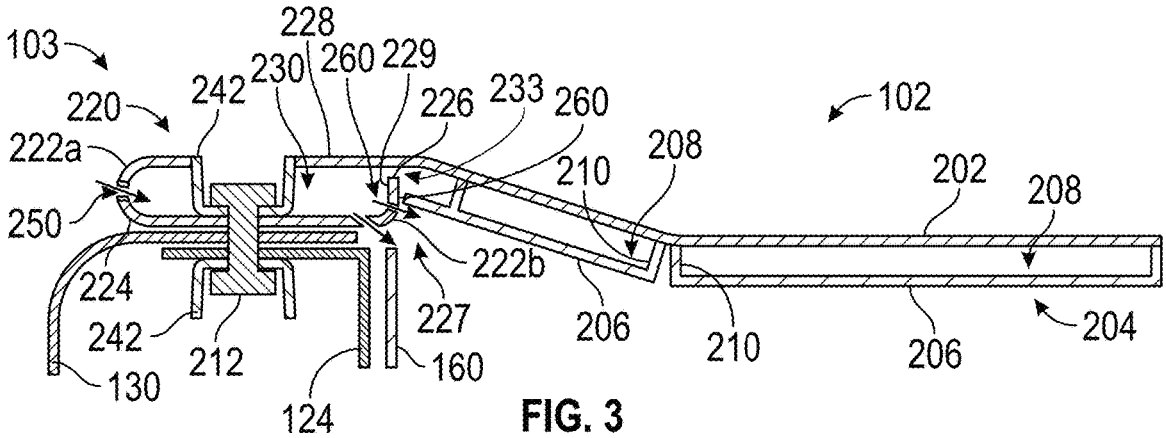
FIG. 3 is a schematic partial cross-sectional view of another embodiment of a forward end of a liner assembly, according to an aspect of the present disclosure.

FIG. 3 is a schematic partial cross-sectional view of another embodiment of the forward end 103 of the outer liner assembly 102. The embodiment of FIG. 3 includes many of the same or similar components and functionality as the embodiment shown in FIG. 2. The same reference numeral is used for the same or similar components in these two embodiments, and a detailed description of these components and functionality is omitted here. Some reference numerals have been removed for clarity.

In FIG. 3, the one or more second bends 222*b* may include one second bend 222*b*. For example, the distal bent portion 227 may include only a first angled portion 229. In FIG. 3, the first angled portion 229 may extend from the substantially rectilinear portion of the free wall 224 at an axial angle of about ninety degrees. The first angled portion 229 may extend from the substantially rectilinear portion of the free wall 224 at any angle greater than zero, as desired. In this way, the free end 226 of the free wall 224 may extend substantially radially. The gap 233 between the free end 226 and the radially inner surface of the connecting wall 228 may be larger than in the embodiment of FIG. 2. The free end 226 may extend toward the radially inner surface of the connecting wall 228 at any radial distance such that the gap 233 may include any size, as desired, for controlling an amount of cooling air that may be directed through the gap 233.

Figure 4:
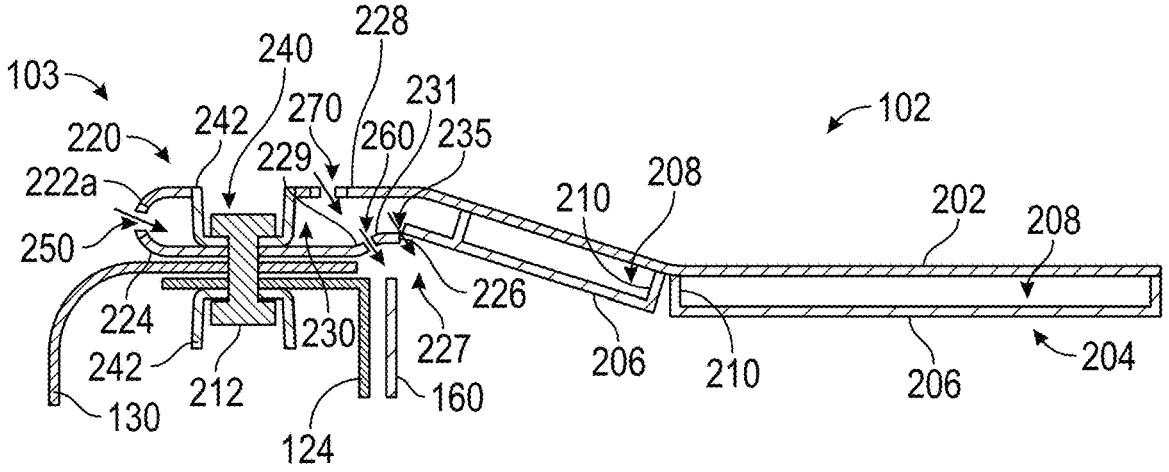
FIG. 4 is a schematic partial cross-sectional view of another embodiment of a forward end of a liner assembly, according to an aspect of the present disclosure.

FIG. 4 is a schematic partial cross-sectional view of another embodiment of the forward end 103 of the outer liner assembly 102. The embodiment of FIG. 4 includes many of the same or similar components and functionality as the embodiment shown in FIG. 2. The same reference numeral is used for the same or similar components in these two embodiments, and a detailed description of these components and functionality is omitted here. Some reference numerals have been removed for clarity.

In FIG. 4, the first angled portion 229 includes less of an angle than in the embodiment of FIG. 2. The second angled portion 231 extends from the first angled portion 229 at less of an angle than the second angled portion 231 of the embodiment in FIG. 2. In this way, the free end 226 of the free wall 224 extends axially towards a proximal end of the heat shield 204 and a gap 235 is formed between the free end 226 and the proximal end of the heat shield 204.

As shown in FIG. 4, the looped section 220 may include one or more third cooling holes 270 for providing cooling air into the cavity 230. The one or more third cooling holes 270 may be located on the connecting wall 228 downstream of the one or more fastener holes 240. For example, the one or more third cooling holes 270 may extend substantially radially through the connecting wall 228. In some examples, the one or more third cooling holes 270 may be located upstream of the one or more fastener holes 240. The one or more third cooling holes 270 may include one or more metering holes such that the cooling air enters the one or more third cooling holes 270 and exits the one or more third cooling holes 270 as a jet (e.g., velocity of the cooling air is increased as the cooling air passes through the one or more third cooling holes 270). The one or more third cooling holes 270 may include a plurality of discrete cooling holes (e.g., multiple separate cooling holes positioned at various circumferential positions on the looped section 220). In some examples, the one or more third cooling holes 270 may include an annular opening that spans around the circumference of the looped section 220. The one or more third cooling holes 270 may include any number of cooling holes, as desired. The one or more third cooling holes 270 may include a combination of discrete cooling holes and/or annular openings. The one or more third cooling holes 270 may include any size and/or shape, and may be positioned at any angle to provide cooling air into the cavity 230.

In operation, in addition to the discharge air 126 (FIG. 1) being directed through the one or more first cooling holes 250, the discharge air 126 may also be directed into the cavity 230 through the one or more third cooling holes 270 (as indicated by the arrow through the third cooling holes 270). The cooling air in the cavity 230 may then be directed through the one or more second cooling holes 260 (as indicated by the arrow through the second cooling holes 260). The cooling air through the second cooling holes 260 may direct the cooling air onto a downstream surface (e.g., a hot side) of the deflector assembly 160 to cool the deflector assembly 160. For example, the cooling air may impinge on the deflector assembly 160 at specific locations around the deflector assembly 160 (e.g., at the corners of the panels of the deflector assembly 160) to prevent hot gas ingestion and to cool the deflector assembly 160.

The cooling air in the cavity 230 may also be directed through the gap 235 toward a hot side of the heat shield 204 (as indicated by the arrow through the gap 235). For example, the cooling air directed through the gap 235 may provide film cooling on the radially inner surface of the one or more panels 206. The direction and/or the amount of cooling air through the first cooling holes 250, the second cooling holes 260, and/or the gap 235 may be sized, shaped, and/or angled to direct the cooling air in various directions, as necessary.

Figure 5:
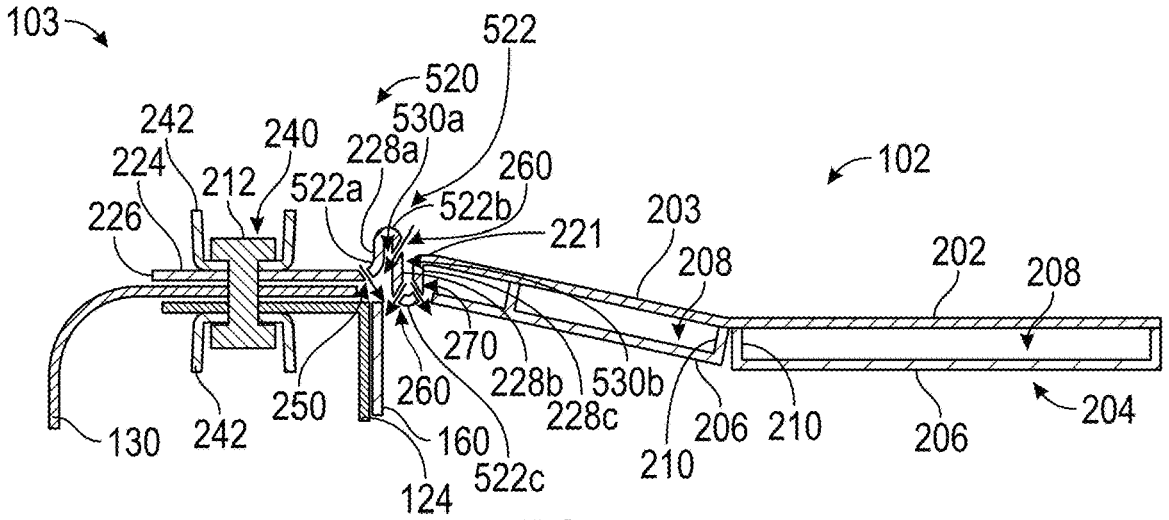
FIG. 5 is a schematic partial cross-sectional view of another embodiment of a forward end of a liner assembly, according to an aspect of the present disclosure.

FIG. 5 is a schematic partial cross-sectional view of another embodiment of the forward end 103 of the outer liner assembly 102. The embodiment of FIG. 5 includes many of the same or similar components and functionality as in the embodiment shown in FIG. 2. The same reference numeral is used for the same or similar components in these two embodiments, and a detailed description of these components and functionality is omitted here. Some reference numerals have been removed for clarity.

In FIG. 5, a looped section 520 may be positioned downstream of the one or more fastening mechanisms 212 and may include a different shape than the looped section 220 of the embodiments shown in FIGS. 2 to 4. The looped section 520 of FIG. 5 may include one or more bends 522 positioned axially downstream of the free wall 224. For example, the free end 226 of the free wall 224 may be positioned upstream of the one or more fastening mechanisms 212. The free wall 224 may extend downstream from the free end 226 and the looped section 520 may begin at an axial position downstream of the one or more fastening mechanisms 212. In this way, the looped section 520 is not considered to loop around the one or more fastening mechanisms 212 as in the embodiments of the looped section 220 of the embodiments of FIGS. 2 to 4.

The one or more bends 522 may include a first bend 522*a* at a downstream end of the free wall 224. The first bend 522*a* may include a bend angle greater than zero such that a first connecting wall 228*a* extends from the free wall 224 at the first bend 522*a*. The first connecting wall 228*a* may extend radially outward from the free wall 224 and may be substantially radial (e.g., the bend angle of the first bend 522*a* may be approximately ninety degrees). The first bend 522*a* may include a first diameter. The size (e.g., the first diameter) and/or the shape of the first bend 522*a* may include any size and/or shape, as desired, for forming a portion of the looped section 520. The free wall 224 may extend from the free end 226 to a first portion of the first bend 522*a*. The first connecting wall 228*a* may extend from a second portion of the first bend 522*a*.

A second bend 522*b* may be defined at a radially outer end of the first connecting wall 228*a*. The second bend 522*b* may form an elongated U-shape or an elongate C-shape. In this way, the second bend 522*b* may form a smoothly curved, arcuate configuration. The second bend 522*b* may include a second diameter. The size (e.g., the second diameter) and/or the shape of the second bend 522*b* may include any size and/or shape, as desired, for forming a portion of looped section 520. The first connecting wall 228*a* may extend to a first portion of the second bend 522*b* and a second connecting wall 228*b* may extend from a second portion of the second bend 522*b*. In this way, the second bend 522*b* may be considered to bend one hundred eighty degrees such that the second connecting wall 228*b* is substantially parallel with the first connecting wall 228*a*. Further the first connecting wall 228*a*, the second bend 522*b*, and the second connecting wall 228*b* may include a shape considered to be an upside-down U-shape.

A third bend 522*c* may be defined at a radially inner end of the second connecting wall 228*b*. The third bend 522*c* may form an elongated U-shape or an elongate C-shape. In this way, the third bend 522*c* may form a smoothly curved arcuate configuration. The third bend 522*c* may include a third diameter. The size (e.g., the third diameter) and/or the shape of the third bend 522*c* may include any size and/or shape, as desired, for forming a portion of looped section 520. The second connecting wall 228*b* may extend to a first portion of the third bend 522*c* and a third connecting wall 228*c* may extend from a second portion of the third bend 522*c*. In this way, the third bend 522*c* may be considered to bend one hundred eighty degrees such that the third connecting wall 228*c* is substantially parallel with the second connecting wall 228*b*. Further the second connecting wall 228*b*, the third bend 522*c*, and the third connecting wall 228*c* may include a shape considered to be a U-shape.

The second bend 522*b* may form a first cavity 530*a* and the third bend 522*c* may form a second cavity 530*b*. The first cavity 530*a* may include a size and/or a shape defined by a size and/or a shape of the second bend 522*b*, the first connecting wall 228*a*, and the second connecting wall 228*b*. In this way, the first cavity 530*a* may include a first volume. The second cavity 530*b* may include a size and/or a shape defined by a size and/or a shape of the third bend 522*c*, the second connecting wall 228*b*, and the third connecting wall 228*c*. In this way, the second cavity 530*b* may include a second volume. The second volume may be substantially similar to the first volume, or may be different (e.g., larger or smaller) than the first volume.

A connecting bend 221 may be formed between the third connecting wall 228*c* and the axially angled portion 203 of the liner 202. The connecting bend 221 may direct the shape of the liner 202 from the axially angled portion 203 to the third connecting wall 228*c* such that the third connecting wall 228*c* extends substantially radially (e.g., rectilinear). The connecting bend 221 may include any size and/or a shape, as desired, for forming a smooth transition between the axially angled portion 203 and the third connecting wall 228*c*.

The looped section 520 may include one or more fastener holes 240 extending therethrough to receive the one or more fastening mechanisms 212. For example, the one or more fastener holes 240 may extend through the free wall 224. In this way, the outer annular dome 124 and the outer cowl 130 may be fastened to the outer liner assembly 102 at the looped section 220 (e.g., at the free wall 224). The one or more fastening mechanisms 212 may also include one or more seals 242, as detailed above with respect to FIG. 2.

As shown in FIG. 5, the looped section 520 may include one or more first cooling holes 250, one or more second cooling holes 260, and one or more third cooling holes 270. The one or more first cooling holes 250 may be located upstream of the first connecting wall 228*a*. For example, the one or more first cooling holes 250 may be located on the first bend 522*a*. One such first cooling hole 250 is shown in FIG. 5. The one or more first cooling holes 250 may be oriented, sized, shaped, and/or positioned to direct cooling air (e.g., discharge air 126) towards a hot side of the deflector assembly 160 (as indicated by the arrow through the first cooling holes 250).

The one or more second cooling holes 260 may be located downstream of the second bend 522*b*. For example, the one or more second cooling holes 260 may include cooling holes on the second connecting wall 228*b* and may include cooling holes on or adjacent the first portion of the third bend 522*c*. Two such second cooling holes 260 are shown in FIG. 5. The one or more second cooling holes 260 that are on the second connecting wall 228*b* may direct cooling air into the first cavity 530*a* (as indicated by the arrows through such one or more second holes 260). The one or more second cooling holes 260 that are on the first portion of the third bend 522*c* may provide cooling air from the second cavity 530*b* (as indicated by the arrows through such one or more cooling holes 260). The one or more second cooling holes 260 may be oriented, sized, shaped, and/or positioned to direct cooling air (e.g., discharge air 126) through the second connecting wall 228*b* and towards the deflector assembly 160 (FIG. 1) (as indicated by the arrows through the second cooling holes 260).

The one or more third cooling holes 270 may be located downstream of the second connecting wall 228*b*. For example, the one or more third cooling holes 270 may include cooling holes on the second portion of the third bend 522*c*. In some examples, the one or more third cooling holes 270 may include cooling holes on the third connecting wall 228*c*. One such third cooling hole 270 is shown in FIG. 5. The one or more third cooling holes 270 may be oriented, sized, shaped, and/or positioned to direct cooling air (e.g., discharge air 126) from the second cavity 530*b* through third bend 522*c* and towards the panels 206 of the heat shield 204 to provide cooling air to the heat shield 204. The direction of the cooling air through the first cooling holes 250 and/or the amount of the cooling air through the first cooling holes 250, the second cooling holes 260, and/or the third cooling holes 270 may be sized, shaped, and/or angled to direct the cooling air in various directions, as necessary.

Figure 6:
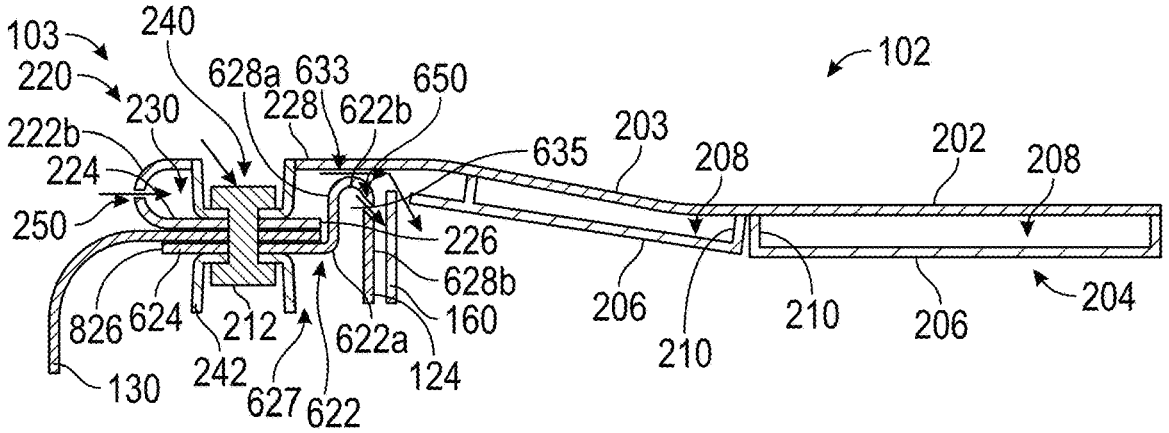
FIG. 6 is a schematic partial cross-sectional view of another embodiment of a forward end of a liner assembly, an aspect of the present disclosure.

FIG. 6 is a schematic partial cross-sectional view of a forward end 103, or an upstream end, of the outer liner assembly 102, according to another embodiment of the present disclosure. The embodiment of FIG. 6 includes many of the same or similar components and functionality as the embodiment shown in FIG. 2. The same reference numeral is used for the same or similar components in these two embodiments, and a detailed description of these components and functionality is omitted here.

In FIG. 6, the looped section 220 is substantially similar to the embodiment of the looped section 220 in FIG. 2, as detailed above. The looped section 220 of FIG. 6, however, does not include the distal bent portion 227 (FIG. 3) of the free wall 224. As shown in FIG. 6, the free wall 224 is substantially rectilinear. The free end 226 of the free wall 224 may be substantially axially aligned with the distal end of the outer cowl 130. In some examples, the free end 226 may be positioned axially distal from the distal end of the outer cowl 130 (e.g., the free end 226 may extend beyond the distal end of the outer cowl 130) or may be positioned axially proximal from the distal end of the outer cowl 130 (e.g., the free end 226 may not extend to or beyond the distal end of the outer cowl 130).

As further shown in FIG. 6, rather than the free wall 224 including the distal bent portion 227 (FIG. 3), the outer annular dome 124 may include a bent section 627. The bent section 627 may be located downstream of the free end 226 of the free wall 224. In this way, the bent section 627 of the outer annular dome 124 may be located downstream of the cavity 230 of the looped section 220.

The bent section 627 may include one or more bends 622. For example, the one or more bends 622 may include a first bend 622*a* and a second bend 622*b*. The outer annular dome 124 may include a free wall 624 having a free end 626 defining a proximal end of the outer annular dome 124. The free wall 624 may extend distally from the free end 626. The first bend 622*a* may be located at a downstream end, also referred to as a distal end, of the free wall 624. The first bend 622*a* may include a bend angle greater than zero degrees such that a first connecting wall 628*a* extends from the free wall 624 at the first bend 622*a*. The first connecting wall 628*a* may extend radially outward from the free wall 624 and may be substantially radial (e.g., the bend angle of the first bend 622*a* may be approximately ninety degrees). The first bend 622*a* may include a first diameter. The size (e.g., the first diameter) and/or the shape of the first bend 622*a* may include any size and/or shape, as desired, for forming a portion of the bent section 627 of the outer annular dome 124. The free wall 624 may extend from the free end 626 to a first portion of the first bend 622*a*. The first connecting wall 628*a* may extend from a second portion of the first bend 622*a*.

The second bend 622*b* may be defined at a radially outer end of the first connecting wall 628*a*. The second bend 622*b* may form an elongated U-shape or an elongated C-shape. In this way, the second bend 622*b* may form a smoothly curved, arcuate configuration. The second bend 622*b* may include a second diameter. The size (e.g., the second diameter) and/or the shape of the second bend 622*b* may include any size and/or shape, as desired, for forming a portion of the bent section 627. The first connecting wall 628*a* may extend to a first portion of the second bend 622*b* and a second connecting wall 628*b* may extend from a second portion of the second bend 622*b*. In this way, the second bend 622*b* may be considered to bend one hundred eighty degrees such that the second connecting wall 628*b* is substantially parallel with the first connecting wall 628*a*. Further the first connecting wall 628*a*, the second bend 622*b*, and the second connecting wall 628*b* may include a shape considered to be an upside-down U-shape. The second bend 622*b* may be located radially adjacent a radially inner surface of the connecting wall 228 of the looped section 220. In this way, a radial gap 633 may be formed between the second bend 622*b* and the radially inner surface of the connecting wall 228. Further, an axial gap 635, also referred to as a cavity, may be formed between the first connecting wall 628*a* and the second connecting wall 628*b*. Although not shown, the second connecting wall 628*b* may extend radially inward from the second bend 622*b* and may define a downstream surface of the outer annular dome 124.

The bent section 627 may include one or more fourth cooling holes 650. The one or more fourth cooling holes 650 may be located on the second connecting wall 628*b*. One such fourth cooling hole 650 is shown in FIG. 6. The one or more fourth cooling holes 650 may also be located on the second bend 622*b*, as desired. The one or more fourth cooling holes 650 may be oriented, sized, shaped, and/or positioned to direct cooling air (e.g., discharge air 126) towards an upstream side, or a cold side, of the deflector assembly 160 (as indicated by the arrow through the fourth cooling holes 650).

In operation, cooling air (e.g., discharge air 126) may enter the cavity 230, as detailed above with respect to FIG. 2. The cooling air in the cavity 230 may then be directed through the radial gap 633 (as indicated by the arrow through the radial gap 633). The cooling air through the radial gap 633 may provide cooling on the liner 202, may provide cooling on a hot side of the heat shield 204, and/or may be directed to provide cooling on the downstream surface of the deflector assembly 160. The cooling air in the cavity 230 may also be directed through the one or more fourth cooling holes 650 and towards the upstream surface of the deflector assembly 160 (as indicated by the arrows through the fourth cooling holes 650). For example, the cooling air may be directed between the downstream surface of the outer annular dome 124 and the upstream surface of the deflector assembly 160. The one or more fourth cooling holes 650 and the radial gap 633 may be metered to further increase a velocity of the cooling air from an upstream side to a downstream side of the one or more fourth cooling holes 650 and the radial gap 633, respectively. The direction and/or the amount of cooling air through the fourth cooling holes 650 and/or the radial gap 633 may be sized, shaped, and angled to direct the cooling air in various directions, as necessary.

Figure 7A:
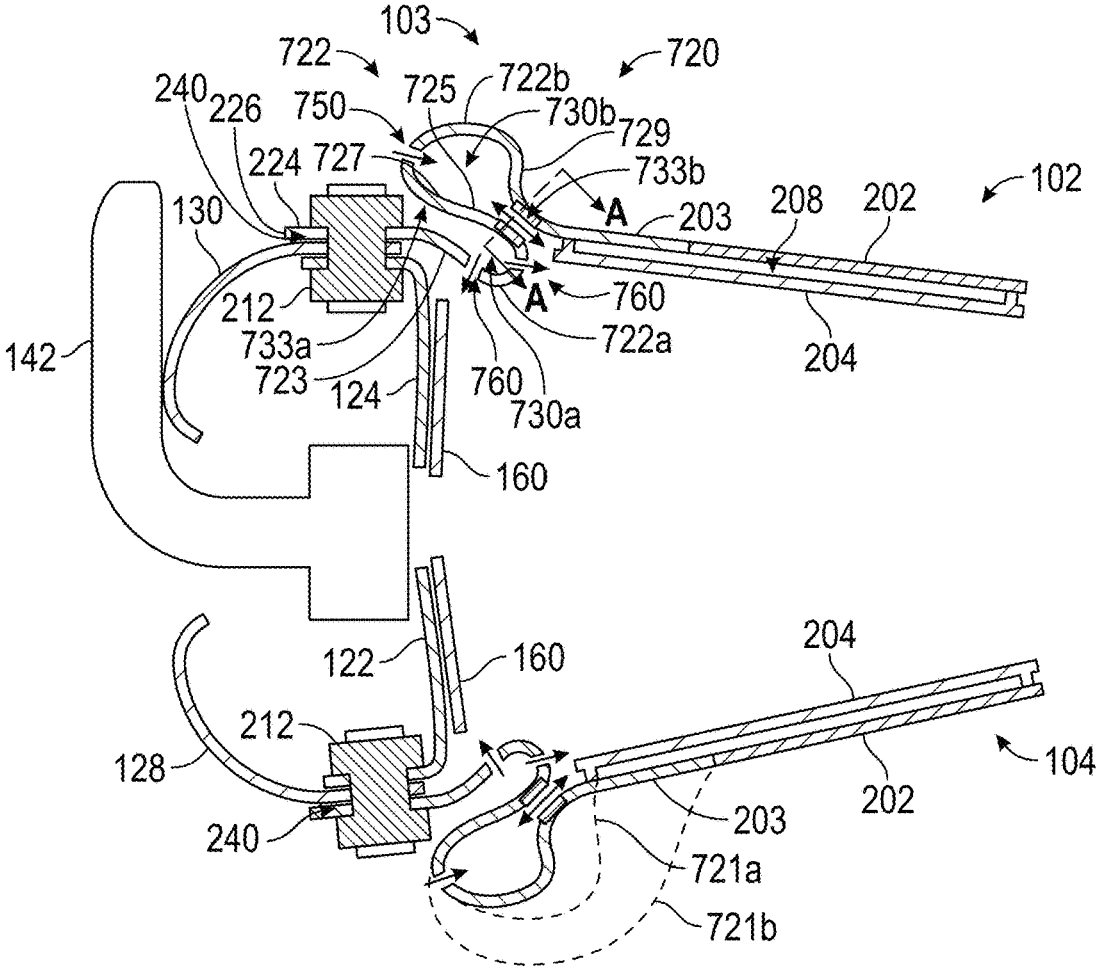
FIG. 7A is a schematic cross-sectional view of another embodiment of a forward end of a liner assembly, according to an aspect of the present disclosure.

FIG. 7A is a schematic cross-sectional view of another embodiment of a forward end 103 of an outer liner assembly 102. The embodiment of FIG. 7A includes many of the same or similar components and functionality as those in the embodiment shown in FIG. 2. The same reference numeral is used for the same or similar components in these two embodiments, and a detailed description of these components and functionality is omitted here. Further, the embodiment of FIG. 7A shows both the outer liner assembly 102 and the inner liner assembly 104.

In FIG. 7A, a looped section 720 may be positioned downstream of the one or more fastening mechanisms 212 and may include a different shape than the looped section 220 of the embodiments in FIGS. 2 to 4 and FIG. 6. The looped section 720 of FIG. 7 may be similar to the looped section 520 of FIG. 5. The looped section 720, however, may include one or more upper case omega shapes, as detailed further below.

The looped section 720 may include one or more bends 722 positioned axially downstream of the free wall 224. For example, the free end 226 of the free wall 224 may be positioned upstream of the one or more fastening mechanisms 212. The free wall 224 may extend downstream from the free end 226 and the looped section 720 may begin at an axial position downstream of the one or more fastening mechanisms 212. In this way, the looped section 720 is not considered to loop around the one or more fastening mechanisms 212 as in the embodiments of the looped section 220 of FIGS. 2 to 4 and FIG. 6.

The one or more bends 722 in the liner 202 form the looped section 720. For example, the liner 202 may include a unitary length of liner 202 bent at a first bend 722*a* to form a first general upper-case omega shape and bent at a second bend 722*b* to form a second general upper-case omega shape. In this way, the first bend 722*a* and the second bend 722*b* may each form a smoothly curved, arcuate configuration. The first bend 722*a* may include a first diameter and the second bend 722*b* may include a second diameter. The size (e.g., the first diameter and the second diameter) and/or the shape of the first bend 722*a* and the second bend 722*b* may include any size and/or shape, as desired, for forming the looped section 220 at the forward end 103 of the liner 202.

The first bend 722*a* may include a first portion 723 and a second portion 725. The first portion 723 may be connected to the downstream end of the free wall 224. The first portion 723 may extend from the free wall 224 at an axial angle less than zero degrees such that the first portion 723 may extend radially inward from the free wall 224. The first bend 722*a* may thus be oriented such that the upper-case omega shape is considered upside down. For example, the first bend 722*a* may extend radially inward from the free wall 224. The second portion 725 may be connected to the second bend 722*b*.

The second bend 722*b* may include a third portion 727 and a fourth portion 729. The third portion 727 may be connected to the second portion 725 of the first bend 722*a* such that the second bend 722*b* is connected to the first bend 722*a*. In this way, the second bend 722*b* and the first bend 722*a* may be considered to share a wall or otherwise may blend into each other. The fourth portion 729 may be connected to the axially extending portion 203. In this way, a unitary structure of the liner 202 may be formed between the free wall 224, the first bend 722*a*, the second bend 722*b*, and the downstream portions of the liner 202. The second bend 722*b* may extend axially outward from the axially angled portion 203 of the liner 202. Thus, the second bend 722*b* may be considered to be a generally right-side-up upper-case omega shape. The first bend 722*a* and the second bend 722*b* may be angled such that a first central longitudinal axis of the first bend 722*a* and a second central longitudinal axis of the second bend 722*b* each includes an axial component and a radial component.

The first bend 722*a* may define a first cavity 730*a* and the second bend 722*b* may define a second cavity 730*b*. A size and/or a shape (e.g., a volume) of the first cavity 730*a* may be defined by the size and/or the shape of the first bend 722*a*. A size and/or a shape (e.g., a volume) of the second cavity 730*b* may be defined by the size and/or the shape of the second bend 722*b*. The first bend 722*a* and the second bend 722*b* may be oriented such that the first cavity 730*a* is downstream of the second cavity 730*b*. The first bend 722*a* may include a first gap 733*a* defined therein and the second bend 722*b* may define a second gap 733*b* defined therein. The first gap 733*a* may enable cooling air into the first cavity 730*a* and the second gap 733*b* may enable cooling air to exit the second cavity 730*b*, as detailed further below.

In FIG. 7A, one or more fastener holes 240 may extend through the free wall 224 to receive the one or more fastening mechanisms 212. In this way, the outer annular dome 124 and the outer cowl 130 may be fastened to the outer liner assembly 102 at the free wall 224. The one or more fastening mechanisms 212 may also include one or more seals 242 (not shown in FIG. 7A), as detailed above with respect to FIG. 2.

As shown in FIG. 7A, the looped section 720 may include one or more first cooling holes 750 and one or more second cooling holes 760. One such first cooling hole 750 and two such second cooling holes 760 are shown in FIG. 7A. The one or more first cooling holes 750 are located on the second bend 730*b* and may be oriented, sized, shaped, and/or positioned to direct cooling air (e.g., discharge air 126) into the second cavity 730*b*.

The one or more second cooling holes 760 may be located on the first bend 722*a*. For example, the one or more second cooling holes 760 may include cooling holes to direct cooling air on the downstream surface of the deflector assembly 160 and may include cooling holes to direct cooling air towards the heat shield 204, as detailed below. The one or more second cooling holes 760 may be oriented, sized, shaped, and/or positioned to direct cooling air (e.g., discharge air 126) through the first bend 722*a* and towards the deflector assembly 160 (as indicated by the arrows through the second cooling holes 260) and/or towards the heat shield 204, as necessary.

In operation, cooling air (e.g., discharge air 126) may be directed through the one or more first cooling holes 750 and into the second cavity 730*b*. The cooling air may then be directed through the second gap 733*b* towards the space 208 and onto the radially inner surface of the liner 202 and/or the radially outer surface of the heat shield 204. The cooling air may also be directed through first gap 733*a* into the first cavity 730*a* and towards the first bend 722*a*. The cooling air may then be directed through the one or more second cooling holes 760 and onto the deflector assembly 160 and/or the hot side of the heat shield 204. In this way, the looped section 720 may cool certain components of the outer liner assembly 102 and/or the inner liner assembly 104. The one or more first cooling holes 750, the one or more second cooling holes 760, the first gap 733*a*, and the second gap 733*b* may be metered to further increase a velocity of the cooling air from an upstream side to a downstream side of the one or more first cooling holes 750, the one or more second cooling holes 760, the first gap 733*a*, and the second gap 733*b*, respectively. The one or more first cooling holes 750, the one or more second cooling holes 760, the first gap 733*a*, and the second gap 733*b* may be sized, shaped, and angled to direct the cooling air in various directions, as necessary.

FIG. 7A also shows various sizes and shapes of the looped section 720. For example, the second bend 722*b* may include a first alternate shape 721*a* and a size shown in a first set of dashed lines at the inner liner assembly 104. The second bend 722*b* may also include a second alternate shape 721*b* and a size shown in a second set of dashed lines at the inner liner assembly 104. Thus, the second bend 722*b* may include various sizes and/or shapes to tune to a specific vibrational frequency, as detailed further below. Although not shown, the first alternate shape 721*a* and the second alternate shape 721*b* may be annular such that the outer liner assembly 102 also includes such shapes. The first bend 722*a* may also include various sizes and/or shapes, accordingly. In this way, the looped section 720 may include any size and/or shape, as necessary, for acoustic dampening, as detailed further below.

Figure 7B:
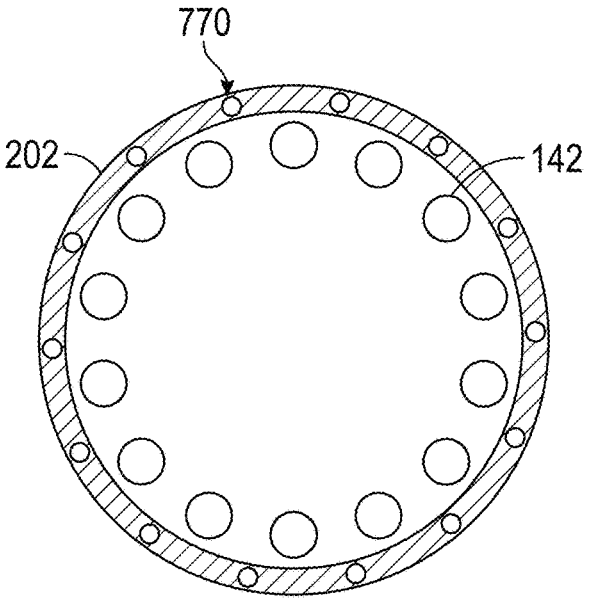
FIG. 7B is a cross-sectional front view of liner assembly taken at line A-A in FIG. 7A, according to an aspect of the present disclosure.

FIG. 7B is a cross-sectional front view of the second gap 733*b* taken along line A-A in FIG. 7A. As shown in FIG. 7B, the liner 202 may include one or more acoustic feed holes 770 positioned circumferentially around an area of the second gap 733*b*. The one or more acoustic feed holes 770 may be positioned around the liner 202 and/or may include any size and/or shape, as desired, to tune to a particular frequency such as to avoid, to reduce, or to prevent vibrations in the liner 202. The acoustic feed holes 770 may be in addition to the cooling holes detailed above. In some examples, the cooling holes may act as acoustic feed holes. In operation, air (e.g., discharge air 126) may pass through the one or more acoustic feed holes 770 and dampen any vibrational frequency in the liner 202, as necessary. For example, the acoustic feed holes 770 act as a Helmholtz resonator such that a volume of air in the acoustic feed holes 770 vibrates at the tuned frequency of the acoustic feed holes 770. The one or more acoustic feed holes 770 may also provide the air for cooling purposes as well. The acoustic feed holes 770 may be used in any of the embodiments of FIGS. 2 to 7A, as detailed above.

The looped sections 220, 520, and 720 detailed above with respect to FIGS. 2 to 7B may be looped and/or bent in a way to provide a compliant joint on the liner 202 at the respective looped sections 220, 520, and 720. The compliant joint may provide a kinematic degree of freedom between connected parts of a monolithic structure. For example, the compliant joint of the looped sections 220, 520, and 720 may provide a kinematic degree of freedom between a portion of the liner 202 upstream of the looped sections 220, 520, and 720 and a portion of the liner 202 downstream of the looped sections 220, 520, 720. Such a compliant joint may provide vibrational dampening such that acoustic oscillations, vibrations, and other mechanical stresses in an area of the looped sections 220, 520, and 720 is reduced. In this way, the looped sections 220, 520, and 720 may reduce or prevent the acoustic oscillations, the vibrations, and/or the mechanical stress (e.g., from the fastening mechanisms 212) from propagating through the liner 202 downstream of the respective looped sections 220, 520, and 720. Thus, the looped sections 220, 520, and 720 may help to increase an overall lifecycle of the liner 202.

The looped sections 220, 520, and 720 of the embodiments shown in FIGS. 2 to 7B may also help to control cooling and placement of cooling holes, as detailed above. In this way, cooling air may be provided to the deflector assembly 160, the outer annular dome 124, the inner annular dome 122, the liner 202 downstream of the looped sections 220, 520, and 720, and/or the heat shield 204. In this way, the cooling arrangement provided by the looped sections 220, 520, and 720 may improve durability and increase a lifecycle of the liner 202, the outer annular dome 124, the inner annular dome 122, and the deflector assembly 160.

The looped sections 220, 520, and 720 may also include a size and/or a shape for further providing acoustic dampening. For example, the volume of the cavities 230, 730*a*, and 730*b*, the length of the free wall 224, and/or the length of the connecting wall 228 may be sized and/or shaped to tune the looped sections 220, 520, and 720 to a specific acoustic frequency, as desired. In this way, the size and/or the shape of the looped sections 220, 520, and 720 (in combination with the cooling holes and acoustic feed holes) may further prevent vibrations and mechanical stress from propagated through downstream portions of the liner 202.

Figure 8A:
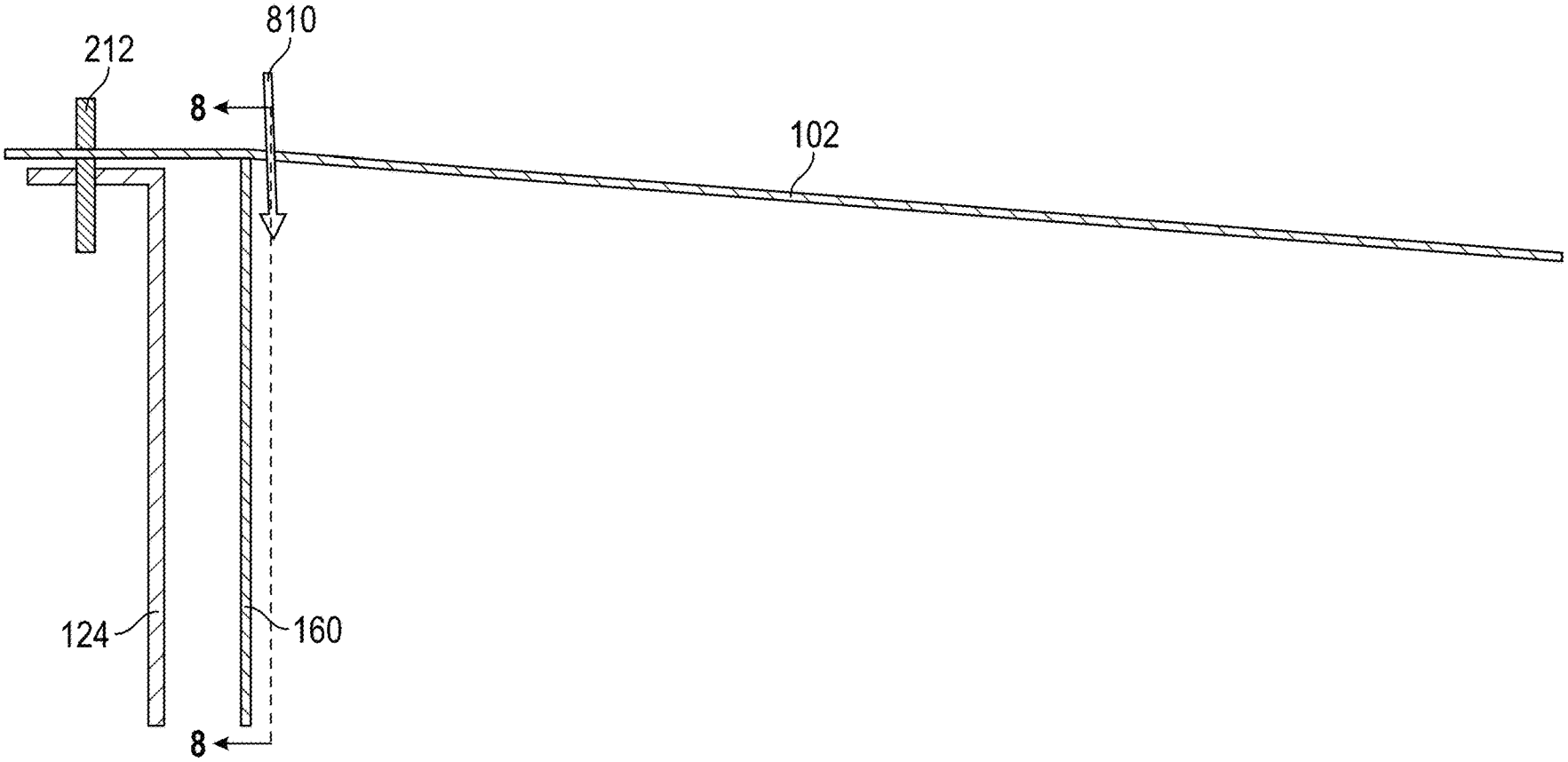
FIG. 8A is a schematic partial cross-sectional view of another embodiment of a forward end of a liner assembly, according to an aspect of the present disclosure.
Figure 8B:
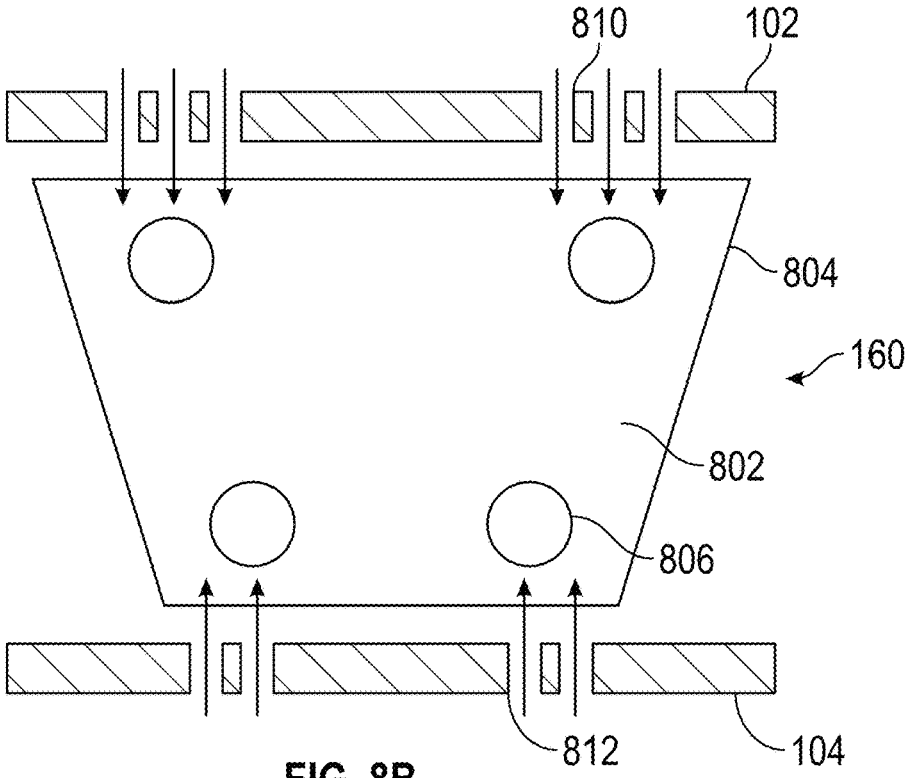
FIG. 8B is a cross-sectional front view, taken at line 8-8 in FIG. 8A, of a downstream surface of a panel of a deflector assembly, according to an aspect of the present disclosure.
Figure 8C:
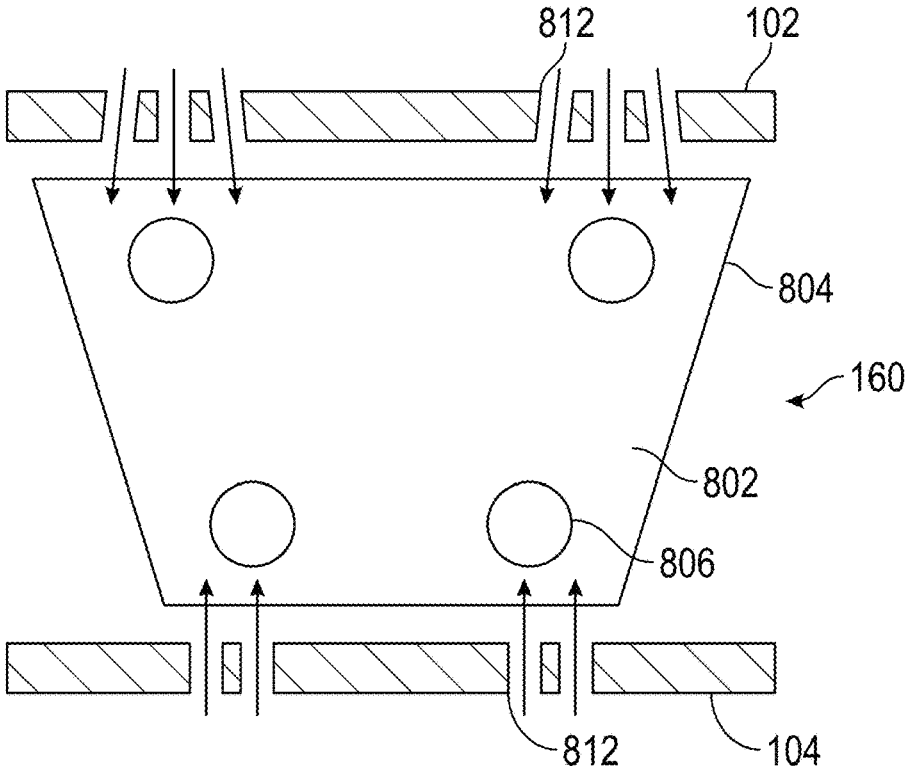
FIG. 8C is a cross-sectional front view of another embodiment of a downstream surface of a panel of a deflector assembly, according to an aspect of the present disclosure.

FIG. 8A is a schematic partial cross-sectional view of a forward end 103, or an upstream end, of an outer liner assembly 102, according to another embodiment. The embodiment of FIG. 8A includes many of the same or similar components and functionality as the embodiment shown in FIG. 2. The same reference numeral is used for the same or similar components in these two embodiments, and a detailed description of these components and functionality is omitted here. While FIG. 8A does not show a looped section at the forward end 103 of the outer liner assembly 102, the forward end 103 of FIG. 8A may, of course, include a looped section, as detailed above. FIG. 8B is a cross-sectional front view of a downstream surface 802 of a panel 804 of the deflector assembly 160, taken at line 8-8 in FIG. 8A, according to aspects of the present disclosure. FIG. 8C is a cross-sectional front view of another embodiment of a downstream surface 802 of a panel 804 of the deflector assembly 160.

The deflector assembly 160 may include one or more panels 804 that together define the deflector assembly 160 (one such panel 804 is shown in FIGS. 8B and 8C). The panel 804 may include one or more fastening mechanisms 806 (e.g., bolts, nuts, screws, brazing, welding, or the like) arranged at or adjacent various corners of the panel 804. The fastening mechanisms 806 may fasten each panel 804 to the annular dome assembly 120 such that the deflector assembly 160 may be fastened to the annular dome assembly 120. The outer liner assembly 102 may include one or more first cooling holes 810 and the inner liner assembly 104 may include one or more second cooling holes 812.

The one or more first cooling holes 810 may extend axially through the outer liner assembly 102 and the one or more second cooling holes 812 may extend axially through the inner liner assembly 104. In this way, cooling air may be provided to an area around the one or more fastening mechanisms 806. In operation, cooling air (e.g., discharge air 126) may flow through the one or more first cooling holes 810 as indicated by the arrows through the one or more first cooling holes 810. The cooling air may also be directed through the one or more second cooling holes 812 as indicated by the arrows through the one or more second cooling holes 812. In FIG. 8B, the cooling may be directed towards the one or more fastening mechanisms 806 in a radial direction. In FIG. 8C, the one or more first cooling holes 810 may be angled with respect to the radial direction such that the cooling air is directed tangentially on the one or more fastening mechanisms 806. Although not shown, the one or more second cooling holes 812 may also be angled with respect to the radial direction to provide cooling air through the one or more second cooling holes 812 tangentially to the one or more fastening mechanisms 806. The embodiments of FIGS. 8A to 8C may be combined and utilized for the cooling holes in the embodiments of FIGS. 2 to 7B.

The embodiments of the present disclosure disclosed herein provide for an improved liner assembly for the combustor to improve durability and a lifecycle of the liner assembly compared to liner assemblies without the benefit of the present disclosure. For example, the compliant joint provided by the looped section (e.g., via the one or more bends) may help to avoid, to reduce, or to prevent vibrations and/or to avoid, to reduce, or to prevent other mechanical stresses from propagating downstream of the looped section. The looped section provides an air cavity that acts as an acoustic damper to further dampen vibrations and mechanical stress, and that can be tuned to a desired frequency. Thus, the looped section may improve durability of the liner assembly and increase a lifecycle of the liner assembly as compared to liner assemblies without the benefit of the present disclosure.

Further aspects of the present disclosure are provided by the subject matter of the following clauses.

A liner assembly for a combustor. The liner assembly includes a liner defining a combustion chamber of the combustor. The liner includes a looped section at a forward end of the liner. The looped section includes one or more bends such that the looped section forms a compliant joint and vibrations are dampened through the liner downstream of the looped section.

The liner assembly of the preceding clause, where the looped section defines one or more cavities.

The liner assembly of any preceding clause, the one or more cavities being sized to dampen acoustic oscillations.

The liner assembly of any preceding clause, further including one or more fastening mechanisms to attach one or more cowls and an annular dome assembly of the combustor to the liner assembly. The one or more cavities dampen acoustic oscillations downstream of the one or more fastening mechanisms.

The liner assembly of any preceding clause, the looped section including a generally C-shaped bend.

The liner assembly of any preceding clause, the looped section including one or more first cooling holes for directing cooling air into the one or more cavities.

The liner assembly of any preceding clause, the looped section including one or more second cooling holes for providing cooling air from the one or more cavities.

The liner assembly of any preceding clause, the looped section including two or more bends defining two or more cavities.

The liner assembly of any preceding clause, the two or more bends each including a generally U-shaped bend.

The liner assembly of any preceding clause, the two or more bends each including a generally Omega-shaped bend.

The liner assembly of any preceding clause, the looped section being defined by a free wall and a connecting wall.

The liner assembly of any preceding clause, the one or more cavities being defined between the free wall and the connecting wall.

The liner assembly of any preceding clause, the connecting wall being radially outward from the free wall.

The liner assembly of any preceding clause, the connecting wall being connected to an axially angled portion of the liner downstream of the looped section.

The liner assembly of any preceding clause, the free wall including a distal bent portion that includes one or more angled portions.

The liner assembly of any preceding clause, a gap being defined by a distal end of the free wall and a radially inner surface of the connecting wall, cooling air being directed through the gap.

The liner assembly of any preceding clause, a gap being defined by a distal end of the free wall and a proximal end of a heat shield of the liner assembly.

The liner assembly of any preceding clause, the one or more fastening mechanisms being disposed within the one or more cavities.

The liner assembly of any preceding clause, further including one or more seals to seal one or more fastener holes in the looped section.

The liner assembly of any preceding clause, the looped section including one or more acoustic feed holes.

The liner assembly of any preceding clause, further including one or more first cooling holes in the liner to direct cooling air radially through the liner to the one or more fastening mechanisms.

The liner assembly of any preceding clause, the one or more first cooling holes in the liner being angled with respect to a radial direction such that the one or more first cooling holes in the liner direct cooling tangentially to the one or more fastening mechanisms.

A combustor assembly for a combustion section of a gas turbine engine. The combustor assembly includes one or more cowls, an annular dome assembly, and a liner assembly having a liner. The one or more cowls and the annular dome assembly are attached to the liner assembly by one or more fastening mechanisms. The liner includes a looped section at a forward end of the liner. The looped section includes one or more bends such that the looped section forms a compliant joint and vibrations are dampened through the liner downstream of the looped section.

The combustor assembly of the preceding clause, the looped section defining one or more cavities.

The combustor assembly of any preceding clause, the one or more cavities being sized to dampen acoustic oscillations.

The combustor assembly of any preceding clause, the one or more fastening mechanisms attaching the one or more cowls and the annular dome assembly to the liner assembly. The one or more cavities dampen acoustic oscillations downstream of the one or more fastening mechanisms The combustor assembly of any preceding clause, the looped section including a generally C-shaped bend.

The combustor assembly of any preceding clause, the looped section including one or more first cooling holes for directing cooling air into the one or more cavities.

The combustor assembly of any preceding clause, the looped section including one or more second cooling holes downstream of the one or more first cooling holes for providing cooling air from the one or more cavities to downstream portions of the liner and/or to portions of the annular dome assembly.

The combustor assembly of any preceding clause, the looped section including two or more bends defining two or more cavities.

The combustor assembly of any preceding clause, the two or more bends each including a generally U-shaped bend.

The combustor assembly of any preceding clause, the two or more bends each including a generally Omega-shaped bend.

The combustor assembly of any preceding clause, the looped section being defined by a free wall and a connecting wall.

The combustor assembly of any preceding clause, the one or more cavities being defined between the free wall and the connecting wall.

The combustor assembly of any preceding clause, the connecting wall being radially outward from the free wall.

The combustor assembly of any preceding clause, the connecting wall being connected to an axially angled portion of the liner downstream of the looped section.

The combustor assembly of any preceding clause, the free wall including a distal bent portion that includes one or more angled portions.

The combustor assembly of any preceding clause, a gap being defined by a distal end of the free wall and a radially inner surface of the connecting wall, cooling air being directed through the gap.

The combustor assembly of any preceding clause, a gap being defined by a distal end of the free wall and a proximal end of a heat shield of the liner assembly.

The combustor assembly of any preceding clause, the one or more fastening mechanisms being disposed within the one or more cavities.

The combustor assembly of any preceding clause, further including one or more seals to seal one or more fastener holes in the looped section.

The combustor assembly of any preceding clause, the annular dome assembly including a bent section located downstream of the looped section.

The combustor assembly of any preceding clause, the looped section including one or more acoustic feed holes.

The combustor assembly of any preceding clause, further including one or more first cooling holes in the liner to direct cooling air radially through the liner to the one or more fastening mechanisms.

The combustor assembly of any preceding clause, the one or more first cooling holes in the liner being angled with respect to a radial direction such that the one or more first cooling holes in the liner direct cooling tangentially to the one or more fastening mechanisms.

Although the foregoing description is directed to the preferred embodiments, other variations and modifications will be apparent to those skilled in the art, and may be made without departing from the spirit or scope of the disclosure Moreover, features described in connection with one embodiment may be used in conjunction with other embodiments, even if not explicitly stated above.

What is claimed is:

1. A liner assembly for a combustor, the liner assembly comprising:

a liner defining a combustion chamber of the combustor, the liner including a first looped section and a second looped section at a forward end of the liner, the first looped section having a first U-shape, a first C-shape, or a first omega shape defining a first cavity and the second looped section having a second U-shape, a second C-shape, or a second omega shape defining a second cavity, the first looped section and the second looped section are oriented opposite to one another such that the first looped section and the second looped section open in opposite directions, the first looped section and the second looped section forming a compliant joint such that vibrations are damped through the liner downstream of the first looped section and the second looped section; and one or more fastening mechanisms configured to fasten one or more cowls and an annular dome assembly to the liner, wherein the first looped section and the second looped section are positioned downstream of the one or more fastening mechanisms.

2. The liner assembly of claim 1, wherein the first cavity and the second cavity are configured to damp acoustic oscillations.

3. The liner assembly of claim 1, wherein the liner includes a free end located upstream of the one or more fastening mechanisms.

4. The liner assembly of claim 3, wherein the liner comprises a free wall extending downstream from the free end, and the first looped section begins at an axial position downstream of the one or more fastening mechanisms such that the first looped section is not looped around the one or more fastening mechanisms.

5. The liner assembly of claim 4, wherein the first looped section comprises a first bend forming a bend angle greater than zero degrees relative to a longitudinal axis of the combustor, and wherein the first looped section comprises a first connecting wall extending from the free wall of the liner at the first bend.

6. The liner assembly of claim 5, wherein the first connecting wall extends radially outward from the free wall.

7. The liner assembly of claim 5, wherein the first looped section comprises a second bend having the first U-shape, the first C-shape, or the first omega shape; and the first U-shape, the first C-shape, or the first omega shape including an elongated U-shape or an elongated C-shape having a smoothly curved, arcuate configuration.

8. The liner assembly of claim 7, wherein the first connecting wall extends from the first bend to a first portion of the second bend, and wherein the first looped section comprises a second connecting wall extending from a second portion of the second bend.

9. The liner assembly of claim 8, wherein the second bend bends one hundred eighty degrees and the second connecting wall extends in a common radial direction with the first connecting wall.

10. The liner assembly of claim 9, wherein the first connecting wall, the second bend, and the second connecting wall define the first U-shape, the first C-shape, or the first omega shape.

11. The liner assembly of claim 8, wherein the one or more bends second looped section includes a third bend having the second U-shape, the second C-shape, or the second omega shape; and the second U-shape, the second C-shape, or the second omega shape including a U-shape or a C-shape such that the third bend forms a curved, arcuate structure.

12. The liner assembly of claim 11, wherein the second connecting wall extends to a first portion of the third bend, and wherein the second looped section comprises a third connecting wall extending from a second portion of the third bend.

13. The liner assembly of claim 12, wherein the third connecting wall is connected to an axially angled portion of the liner.

14. The liner assembly of claim 12, wherein the third bend bends one hundred eighty degrees such that the third connecting wall extends in a common radial direction with the second connecting wall.

15. The liner assembly of claim 14, wherein the second connecting wall, the third bend, and the third connecting wall define the second U-shape, the second C-shape, or the second omega shape.

16. The liner assembly of claim 11, wherein the second bend forms a portion of the first cavity and the third bend forms a portion of the second cavity.

17. The liner assembly of claim 1, wherein a volume of the first cavity is substantially equal to a volume of the second cavity.

18. The liner assembly of claim 1, wherein the first looped section or the second looped section, or both includes one or more cooling holes configured to direct cooling air into or out of the first cavity or the second cavity, or both.

19. The liner assembly of claim 18, wherein the second looped section is connected to the first looped section, wherein one or more first cooling holes are provided within the first looped portion section and one or more second cooling holes are provided within the second looped section.

20. A combustor assembly for a combustion section of a gas turbine engine, the combustor assembly comprising:

one or more cowls;

an annular dome assembly;

a liner defining a combustion chamber, the liner including a first looped section and a second looped section at a forward end of the liner, the first looped section having a U-shape, a C-shape, or an omega-shape defining a first cavity and the second looped section having a U-shape, a C-shape, or an omega-shape defining a second cavity, the first looped section and the second looped section are oriented opposite to one another such that the first looped section and the second looped section open in opposite directions, the first looped section and the second looped section forming a compliant joint such that vibrations are damped through the liner downstream of the first looped section and the second looped section; and one or more fastening mechanisms configured to fasten the one or more cowls and the annular dome assembly to the liner, wherein the first looped section and the second looped section are positioned downstream of the one or more fastening mechanisms.

* * * * *